United States Patent [19]

Caramanica et al.

[11] Patent Number: 4,865,571

[45] Date of Patent: Sep. 12, 1989

[54] HAND-HELD ICE GRAB AND WATER PADDLE

[76] Inventors: Donald S. Caramanica, 76 Maple St., P.O. Box 451, Plympton, Mass. 02367; Michael J. O'Connell, 13 Dartmouth Cir., Pembroke, Mass. 02359

[21] Appl. No.: 250,086

[22] Filed: Sep. 28, 1988

[51] Int. Cl.[4] ..... B63H 16/04

[52] U.S. Cl. ..... 440/101; 416/70 R; 441/82; 294/61

[58] Field of Search ..... 441/82; 114/221 R, 220; 440/101; 416/70 R; 294/61; 30/164.5

[56] References Cited

U.S. PATENT DOCUMENTS

| | | | |
|---|---|---|---|
| 816,681 | 4/1906 | Piller | 441/82 |
| 2,777,724 | 1/1957 | Carter | 294/61 |
| 3,030,641 | 4/1962 | Ake | 114/221 R |
| 3,331,625 | 7/1967 | Berry | 294/61 |
| 4,079,953 | 3/1978 | Howarth, Jr. | 441/82 |
| 4,493,663 | 1/1985 | Richmond | 440/101 |

*Primary Examiner*—Joseph F. Peters, Jr.
*Assistant Examiner*—Edwin L. Swinehart
*Attorney, Agent, or Firm*—Donald W. Meeker

[57] ABSTRACT

A flat rigid rectangular plate has four corners bent down to form rigid V-shaped points to grip on an ice surface. The plate is larger than an adult hand and serves as a hand-held paddle in water. A longer spike or triangular point extends away from the plate at a right angle to the V-shaped points for gripping an ice surface through a snow cover. A handle extending from the top of the plate maybe equipped with a safety cord to loop over the wrist of the user. The handle may be permanently upright or foldable.

11 Claims, 1 Drawing Sheet

HAND-HELD ICE GRAB AND WATER PADDLE

BACKGROUND OF THE INVENTION

1. Technical Field

The present invention relates to hand-held implements for propelling an amphibious human transport device traveling through water, over ice and over snow-covered ice and for gripping ice to pull the amphibious device out of the water onto the ice and in particular to such a hand-held ice grab and water paddle for propelling and manipulating an amphibious ice rescue sled.

2. Description of the Prior Art

No prior art implements provide multiple use functions for propelling and manipulating human transport devices over ice, over snow covered ice and through water.

Prior art implements used for propelling human transport devices over ice have been primative and limited primarily to ice picks and other types of single-pronged implements which have minimal effectiveness on ice and no water propelling function.

DISCLOSURE OF INVENTION

Providing a hand-held ice grab and water paddle combining a flat surface, multiple V-shaped points and a long pont enables multiple use: through water, over ice and over snow-covered ice as well as making the transition from water onto ice.

Multiple large V-shaped points create a strong gripping action similar to that of a polar bear's claw enabling sure and rapid gripping action sufficient to pull a loaded human transport device out of water onto ice. Greater force may be exerted with multiple large claws than with a single point without slippage of the claws enabling higher speeds in propelling a sled-type device over ice.

Providing safety cords secured to the wrists of a rescue worker prevents loss of the ice gripping devices while traveling over the ice and enables manipulation of a person in the water by releasing the devices to hang down from the wrists while working to save the person.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
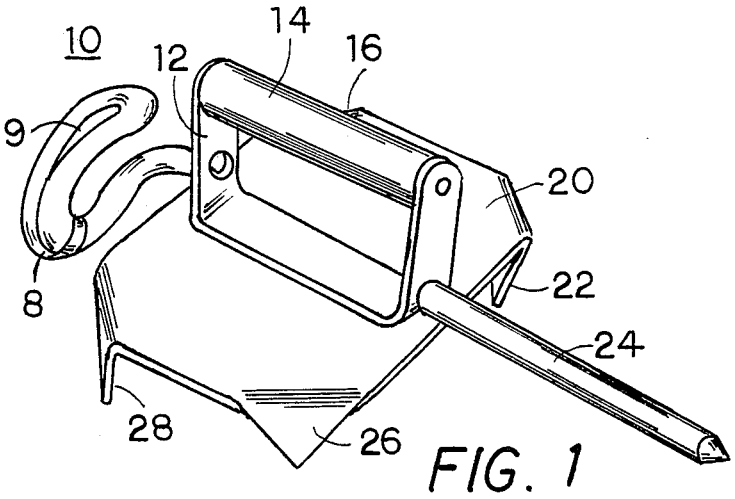
FIG. 1 is a perspective view of the ice grab and water paddle.
Figure 2:
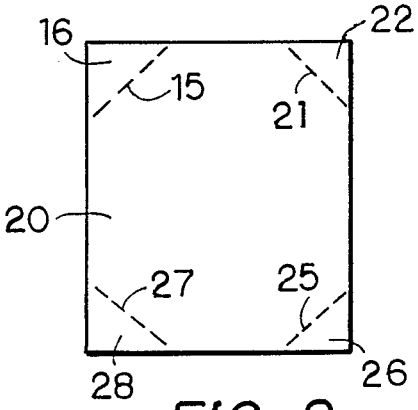
FIG. 2 is a plan view of the rigid flat plate showing where to bend the corners to create the V-shaped points.

In FIGS. 1 and 2 a multiple function hand-held ice grab and water paddle for moving amphibious human transport devices comprises a rigid flat plate 20 four times larger in surface area than an adult hand, which plate has an upper and lower surface and a peripheral edge. In the preferred embodiment the rigid plate is formed of 1/16 inch stainless steel. Rigidly secured to the upper surface a handle means to be grasped by a single hand formed by a U-shaped metal bracket 12 welded to the plate and a rigid handle grip 14 in the form of a large diameter circular post of sufficient diameter to be grasped by an adult hand. The handle grip is screwed into the bracket.

Rigidly protruding from the lower surface are at least two rigid V-shaped points approximately equal in length. In the preferred embodiment four V-shaped points 16, 22, 26 and 28 are formed by bending down the corners of the rigid plate along dashed lines 15, 21, 25 and 27, as seen in FIG. 2.

Rigidly protruding from the flat plate approximately at a right angle to the V-shaped points is a substantially longer rigid point 24 in the form of a large spike with a broad pointed outer end. The spike is welded to the handle bracket, and a longitudinal axis of the handle.

A safety cord 8 is secured to the ice grab and water paddle through a hole in the handle bracket, wherein the safety cord is provided with a loop means 9 for attaching to a wrist of a wearer. In the preferred embodiment the safety cord comprises a bungee-type cord.

Figure 3:
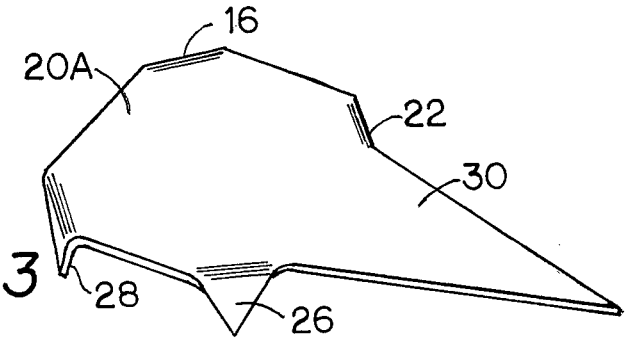
FIG. 3 is a perspective view of the rigid flat plate in an alternate embodiment of the invention with a triangular longer rigid point.
Figure 4:
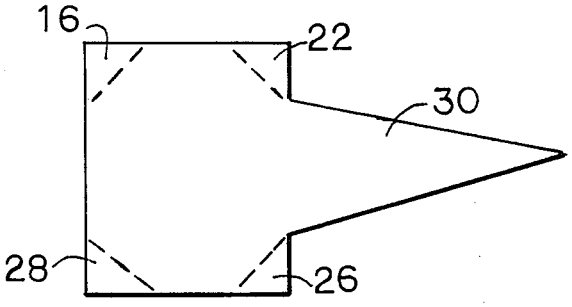
FIG. 4 is a plan view of the alternate embodiment of the rigid flat plate showing where to bend the corners to create the V-shaped points.

In FIGS. 3 and 4 an alternate embodiment of the invention provides a longer rigid point 30 in the form of a long triangular extension of the flat plate.

Figure 5:
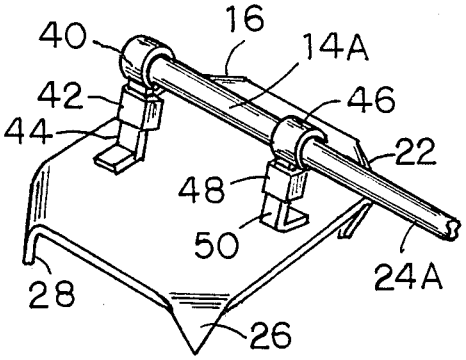
FIG. 5 is a perspective view of another alternate embodiment of the invention having a foldable handle.
Figure 6:
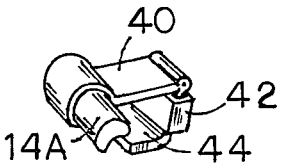
FIG. 6 is a perspective view of the alternate handle support folded down.

In FIGS. 5 and 6 another alternate embodiment of the invention the handle comprises two brackets 44 and 50 rigidly extending from the upper surface of the rigid plate spaced apart by a distance larger than a width of an adult hand. Each bracket comprises a hinged element having a bottom portion 44 and 50 welded to the plate, an upper portion 40 and 46 hinged to the lower portion and a movable sleeve 42 and 48 to fit over the hinged element securely when the ice grab and water paddle is in use as in FIG. 5. The sleeve can be moved away from the hinged element to allow the handle to fold flat against the rigid plate when the ice grab and water paddle is not in use as in FIG. 6. Rigidly secured between the brackets a large diameter circular post 14A is of sufficient diameter to be grasped by an adult hand. In this embodiment the longer rigid point 24A is a spike extending from the circular post.

It is understood that the preceding description is given merely by way of illustration and not in limitation of the invention and that various modifications may be made thereto without departing from the spirit of the invention as claimed.

We claim:

1. A multiple function hand-held ice grab and water paddle for moving amphibious human transport devices, wherein the hand-held ice grab and water paddle comprises:

a rigid flat plate larger in surface area than an adult hand, which plate has an upper and lower surface and a peripheral edge;

rigidly secured to the upper surface, a handle means to be grasped by a single hand;

rigidly protruding from the lower surface, at least two rigid V-shaped points approximately equal in length;

rigidly protruding from the flat plate approximately at a right angle to the V-shaped points, a substantially longer rigid point.

2. The invention of claim 1 further comprising a safety cord secured to the propelling implement, wherein the safety cord is provided with a means for attaching to a wrist of a wearer.

3. The invention of claim 2 wherein the safety cord comprises a bungee-type cord secured to the handle and the wrist securing means comprises a loop in the bungee-type cord.

4. The invention of claim 1 wherein the handle is parallel to the flat plate and a longitudinal axis of the longer rigid point is parallel to a longitudinal axis of the handle.

5. The invention of claim 1 wherein the longer rigid point is a large spike with a broad pointed outer end.

6. The invention of claim 1 wherein the longer rigid point is a long triangular extension of the flat plate.

7. The invention of claim 1 wherein the rigid plate further comprises said at least two points being on the peripheral edge and the points are bent below the lower surface of the plate, thereby forming said V-shaped points.

8. The invention of claim 7 wherein the rigid plate is rectangular in shape having all for corners bent below the lower surface to form said V-shaped points.

9. The invention of claim 8 wherein the rigid plate is 1/16 inch stainless steel.

10. The invention of claim 1 wherein the handle comprises two rigid brackets rigidly extending from the upper surface of the rigid plate spaced apart by a distance larger than a width of an adult hand and rigidly secured between the brackets, a large diameter circular post of sufficient diameter to be grasped by an adult hand.

11. The invention of claim 1 wherein the handle comprises two brackets rigidly extending from the upper surface of the rigid plate spaced apart by a distance larger than a width of an adult hand and, rigidly secured between the brackets, a large diameter circular post of sufficient diameter to be grasped by an adult hand, wherein each bracket comprises a hinged element and a movable sleeve to fit over the hinged element securely when the ice grab and water paddle is in use and the sleeve can be moved away from the hinged element to allow the handle to fold flat against the rigid plate when the ice grab and water paddle is not in use.

* * * * *